United States Patent [19]

Lankry

[11] Patent Number: 4,653,358

[45] Date of Patent: Mar. 31, 1987

[54] TOOLS FOR USE IN TIGHTENING OR REMOVING SCREW-THREADED FASTENERS

[75] Inventor: Julien J. L. Lankry, Hillcrest, Brookdale Road, Gatley, Cheshire, England

[73] Assignees: Julien Jean Louis Lankry; John Morton Johnson

[21] Appl. No.: 745,216

[22] Filed: Jun. 17, 1985

[30] Foreign Application Priority Data

Apr. 18, 1985 [GB] United Kingdom ..... 8510016

[51] Int. Cl.[4] ..... B25B 23/157

[52] U.S. Cl. ..... 81/474; 81/429; 81/469; 81/57.14

[58] Field of Search ..... 81/57.14, 57.3, 429, 81/467, 473, 474

[56] References Cited

U.S. PATENT DOCUMENTS 2,893,278 7/1959 Rice ..... 81/467
3,983,759 10/1976 Linden ..... 81/57.3 X
4,231,270 11/1980 Totsu ..... 81/474
4,237,946 12/1980 Leitner ..... 81/429
4,262,501 4/1981 Vaughn et al. ..... 81/474 X

*Primary Examiner*—Frederick R. Schmidt
*Assistant Examiner*—Maurina Rachuba
*Attorney, Agent, or Firm*—Spensley Horn Jubas & Lubitz

[57] ABSTRACT

A device for rotating a screw into or out of a workpiece, the device being connectible to a power drill and including a screw driving member. There is provided between the power drill and the screw driving member a mechanism for determining the direction of rotation of the screw-driving member and a torque-adjusting mechanism for controlling the depth a screw is to be driven into a workpiece and including clutch means rotatably associated with the rotational-direction determining mechanism. The rotational-direction determining mechanism comprises a planetary gear system, whereof the planet carrier is adapted to be locked to effect rotation of the screw-driving member in a screw-extraction sense (i.e. reverse rotation) or to be released to effect rotation of the screw-driving member in a screw-insertion sense (i.e. forwards rotation).

50 Claims, 10 Drawing Figures

TOOLS FOR USE IN TIGHTENING OR REMOVING SCREW-THREADED FASTENERS

BACKGROUND OF THE INVENTION

This invention relates to tools, and in particular to tools for use in tightening or removing screw-threaded fasteners such, for example, as screws, bolts, nuts or the like (hereinafter and in the claims simply called "screws" for convenience).

In addition to the use of screwdrivers or spanners by hand, it is known to use power tools for the above purpose. The use of power tools is particularly advantageous in the event that a large number of screw are to be tightened or removed since in such a case the use of hand tools can be arduous and cause discomfort to the person concerned.

However particular difficulty is experienced in the use of power tools in the case of inserting and tightening or removing screws into or out of a workpiece or fixture. This is due to the lack of control exercisable by the operator of the power tool on the retention of the tool in or around the screw head and in respect of the direction of intended insertion or removal of the screw into or out of the workpiece or fixture. Also such power tools as have been proposed are expensive and unless they are used frequently such expense is not justified.

It has already been proposed to provide means whereby the abovementioned operation can be performed with the use of a power tool in a manner not having the aforementioned disadvantages, or at least in which such disadvantages are substantially reduced. In this connection see, for example, United Kingdom Pat. No. 2 088 264 B whereof the present Applicant is the inventor and a joint proprietor.

It is an object of the present invention to provide an improved power-driven device for both driving in and extracting screws which can easily and readily be converted to either of these operational modes.

SUMMARY OF THE INVENTION

According to the present invention there is provided a device for rotating a screw into or out of a workpiece, the device being adapted to be secured to a rotary machine and to a screw-driving member and comprising a mechanism for determining the direction of rotation of the screw driving member, and a torque-adjusting mechanism for controlling the depth a screw is to be driven into a workpiece and including clutch means rotatably associated with the rotational-direction determining mechanism.

To avoid any doubt the term "screw" used herein and in the claims is intended to include screws, for example wood screws, bolts, studs, nuts or the like having a screw-threaded portion and having a slot, a recess or an outer form adapted to receive a screwdriver, allen key or spanner for the purpose of tightening or removal of the screw.

BRIEF DESCRIPTION OF THE DRAWINGS

An embodiment of the present invention will now be described by way of example, with reference to the accompanying drawings, in which.

DETAILED DESCRIPTION OF THE DRAWINGS

Figures 1, 2, 3, 4, 7, 8:
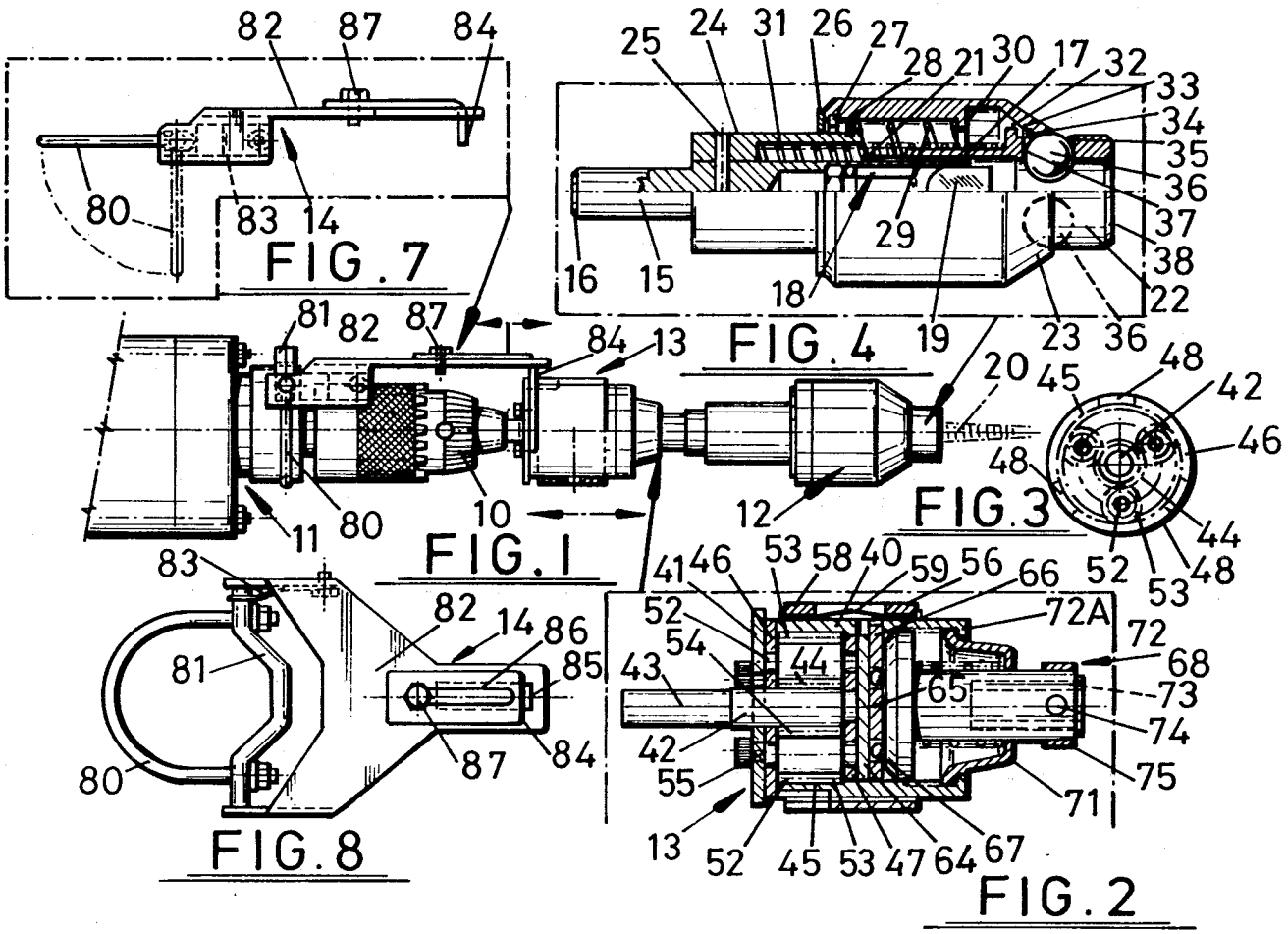
FIG. 1 is a side elevation of a device for rotating a screw to insert same into or remove same from a workpiece.
FIG. 2 is a sectional view of the directional-control and torque adjustment mechanism of the rotating device.
FIG. 3 is a detail view in transverse section of the mechanism of FIG. 2.
FIG. 4 is a half sectional view of the screw-retention and rotation mechanism of the rotating device.
FIG. 7 is a side elevation of the manual adjustment device for the mechanism of FIG. 2.
FIG. 8 is a plan view of the device of FIG. 7.

Referring to FIGS. 1 to 9, the screw rotating device or tool comprises three assemblies connected directly or indirectly to the chuck or jaws 10 of a power drilling machine generally indicated at 11. Such machine may, of course, and most likely will be a hand-held power drill.

The three assemblies comprise a screw holding and driving mechanism 12, a mechanism 13 for determining the direction and rotational speed of screwing, and an adjustment mechanism 14 which serves to control the mechanism 13.

The screw holding and driving mechanism 12 is substantially as disclosed in United Kingdom Pat. No. 2 088 264 B, whereof the present Applicant is the inventor and a joint proprietor.

This mechanism 12 comprises an elongate member of shaft 15, one end 16 of which is received in the mechanism 13 as will be described later. The other end 17 of the shaft 15 is provided with an axially extending bore 18 of hexagonal cross-section and in which a bit 19 is received. The bit 19 is a flat bladed screwdriver but may be replaced by a cruciform screwdriver bit or an allen key bit as required by a screw generally indicated at 20 to be tightened or unscrewed. The bit 19 is retained in the bore 18 by means of a resilient O-ring 21, the bore 18 being of a length such that the free end 17 of the shaft 15 is substantially in alignment with the blade of the bit 19 in order to act as a guiding support for the screw 20 when engaged by the bit 19. Preferably the bore 18 is chamfered at the end 17 for this purpose.

Inner 22, and outer 23, guide sleeves surround the shaft 15 and the bit 19 and are movable axially relative thereto and relative to each other.

A sleeve 24 is secured to the shaft 15 by a pin 25, and a washer 26 is also suitably secured to the sleeve 24, which washer 26 is butted by the outer sleeve 19. An internal circlip 27 in the outer sleeve 19 abutting an outer circlip 28 on the sleeve 24 limits the movement of the outer sleeve 23 away from the external end of the sleeve 24. A spring 29 is disposed within the outer sleeve 23 to react between the circlip 28 and an internal rib 30 so as to bias the outer sleeve 23 away from the end 16 and of the shaft 15. The inner sleeve 22 is resiliently biased away from the end 16 by a spring 31 and is limited in its axial movement by a rib 32 abutting an internal conical surface 33 of the outer sleeve 23. The conical surface 33 is stepped at 34 so as to accommodate a wide range of screw shank diameters with which the tool may be used. The inner sleeve 22 has four apertures 35 in which balls 36 are retained, the apertures 35 having a lip 37 at the inner edge to prevent the balls 36 from passing therethrough and also maintaining separation of the balls 36 when in their innermost position and not retaining a screw 20 within the tool. In this way also a wide range of sizes of screw can be accommodated by the tool.

Figure 5:
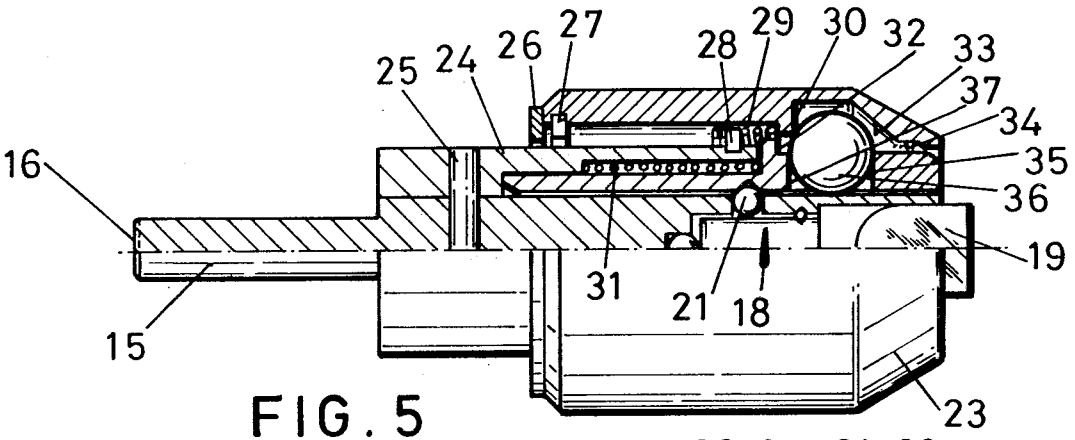
FIG. 5 is a sectional view similar to FIG. 4 in a screw holding position.

Before use of the tool it is in a configuration as shown in FIG. 4 with the inner sleeve 22 protruding from the outer sleeve 23 (by pushing the inner sleeve 22 into the outer sleeve 23) against the force of the spring 31 the head of a screw may be inserted into the tool. The balls 36 can, if necessary, move radially outwardly along the conical surface 33 to allow the head of a screw to pass therebetween and to engage the bit 19. The tool will then be in the configuration substantially as shown in FIG. 5. The spring 31 will then push inner sleeve 18 in the opposite direction so that balls 36 are forced radially inwardly to engage the shank of the screw 20, the head of the screw being retained in contact with the bit 19 and guidingly supported by the end 17 of the shaft 15.

The screw 20 is then offered to the workpiece and screwing commenced. During this operation the screw 20 is securely located by the tool as above described. Eventually the outer end 38 of the inner sleeve 22 abuts the workpiece and further screwing causes the inner sleeve 22 to be retracted into the outer sleeve 23. Thereafter the outer sleeve 23 also abuts the workpiece and both sleeves 22, 23 are forced towards the end 16 of the shaft 15. Continuance of the screwing action causes the retraction of the inner sleeve 22 into the outer sleeve 23 to allow the balls 36 to move radially outwardly so that the screw 20 is released and the head of the screw can again pass between the balls 36.

Figure 6:
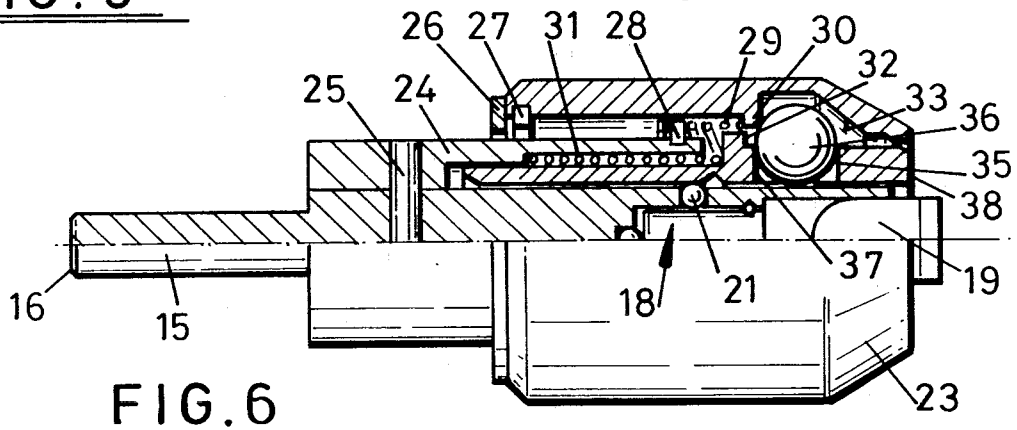
FIG. 6 is a sectional view similar to FIGS. 4 and 5 at the end of a screwing or unscrewing operation.

When the situation as shown in FIG. 6 is reached the bit 19 protrudes from the outer and inner sleeves 22, 23 and can be disengaged from the screw, screwing thus being ceased.

To unscrew, the mechanism 12 starts from the configuration shown in FIG. 6 to permit the bit 19 to engage the screw head. Unscrewing draws the screw 20 into the space between the balls 36 so that they can engage and support the shank of the screw 20.

In effect, the mechanism 12 during the unscrewing operation takes up the configuration of FIG. 6 initially, then FIG. 5 and finally FIG. 4.

Reference is now made to the mechanism 13 which is in effect a forward and reverse planetary gear and a torque adjustment.

The mechanism 13 comprises an inner sleeve 40 having at one end a closing plate 41 provided with a central opening surrounded by the equi-angularly spaced openings radially outwards of the central opening.

A drive shaft 42 with an outer squared end 43 extends into the inner sleeve 40 and mounts a gear wheel 44 the squared end 43 being received in the chuck or jaws 10 of the power drill 11.

The inner sleeve 40 is peripherally internally geared as indicated at 45 at its end adjacent the closing plate 41.

Between the closing plate 41 and the adjacent end of the inner sleeve 40 is a gear support plate 46 having openings corresponding to those in the closing plate 41. Axially spaced from the gear support plate 46 and the closing plate 41 is a second gear support plate 47 having complementary openings to those of the support plate 46.

The circumference of the gear support plate 46 is provided with three equi-angularly spaced cut-outs or recesses 48.

The inner sleeve 40 has on its outer circumference two axially spaced grooves 49, is formed with a radial hole 50 intermediate its ends, and is externally slotted as indicated at 51 at the closing plate end.

Three rotatable shafts or spindles 52 each carrying a gearwheel 53 bridge and connect the gear support plates 46 and 47, the gear wheels 53 meshing with the central gear wheel 44 and the gear annulus 45 of the inner sleeve 40. Thus these gears 44, 45 and 53 constitute a planetary gear. The spindles 52 are received in the three equi-angularly spaced openings in the support plates 46 and 47.

The support plates 46 and 47 are spaced apart by bushes 54 within which are secured headed fastening bolts 55 extending through complementary holes in the closing plate 41, the gear support plate 46 and the gear support plate 47, the holes in the latter being tapped.

An outer sleeve 56 surrounds the inner sleeve 40 and is axially movable relative to the latter. The outer sleeve 56 has at each end a slot 57 within which is received an end of a flat tension spring 58 having a central dimple 59 engageable in one of the grooves 49 of the inner sleeve 40. The outer sleeve 56 has a slot 60 intermediate its ends and aligned with the end slots 57. Thus, the central portion of the flat tension spring 58 registers with the slot 60. The outer sleeve 56 is slotted as indicated at 61 at a location diametrically opposed to the end slots 57 and the intermediate slot 60 and at said location is formed with an inner key 62 engageable in the slot 51 of the inner sleeve 40.

Finally, the outer sleeve 56 has on its outer surface a pair of etched marker lines 63.

A bearing plate 64 abuts the gear support plate 47 and abutting the plate 64 is a torque limit bearing plate 65 having a circumferential projection 66 keying it to the inner sleeve 40. This torque limit bearing plate 65 has three equi-angularly spaced holes each of which accommodates a ball bearing 67.

An output drive shaft 68 having an integral frusto-conical bearing plate 69 is located within the inner sleeve 40, the bearing plate 69 having three radial grooves 70 which at their inner ends engage the ball bearings 67. The bearing plates 65, 69 and ball bearing 67 thus constitute a clutch.

The inner sleeve 40 is closed by a screw cap 71 through which the output drive shaft 68 extends, a tension spring 72 within the cap 71 surrounding the output drive shaft 68 and loading the bearing plate 69 against the ball bearings 67.

A retaining spring 77A engages the outer surface of the cap 71 and the inner surface of the inner sleeve 40 to resist egress of the cap 71 from the inner sleeve.

It will be manifest that the torque applied during screwing or unscrewing can be varied by adjusting the screw cap 71 relative to the inner sleeve 40. This allows the depth of inward screwing to be varied.

The output drive shaft 68 has a hexagonal blind bore 73 for receiving the end 16 of the shaft 15 of the mechanism 12 which is releasably secured in position by a ball bearing 74 carried by the shaft 68 and a surrounding clip or sleeve 75 which forces the ball bearing 74 against the end 16 of otherwise.

The outer sleeve 56 is, in fact, a gear selector sleeve which is used to determine forward or reverse gear and here it should be noted that the gear ratios are selected to give a reverse drive which is one third the speed of the forward drive. The gearing and gear ratios could be varied to provide a different lesser speed reverse drive.

Before describing the selection of forward or reverse gear, the control mechanism 14 will be described.

This mechanism 14 comprises a U-bolt 80 by which the mechanism is secured to the power drill 11, the limbs of the U-bolt 80 being connected by a yoke 81 on which is pivoted a support frame 82. A tension leaf spring 83 interconnects the yoke 81 and the support frame 82 and serves normally to urge the latter to a vertical position.

The support frame 82 carries at its yoke-remote end an adjusting plate or finger 84 which depends when the support frame 82 is horizontal. The position of this adjusting plate 84 relative to the support frame 82 is changed by means of complementary slots 85, 86 in the support frame 82 and the adjusting plate 84 respectively and a securing bolt 87.

To select reverse drive for unscrewing the outer sleeve 56 is pushed forwards relative to the inner sleeve 40, i.e. towards the mechanism 12, and the support frame 82 is pivoted to the horizontal position to engage the adjusting plate or finger 84 in one of the slots of the gear support plate 46. This holds the gear support plates 46 and 47 (the planet carrier) and gear wheels 53 against bodily rotation thus causing the annulus gear 45 and consequently the inner and outer sleeves 40 and 56 and the clutch 65, 67, 69 and output drive shaft 68 to rotate in counter direction to the direction of rotation of the shaft 43 and at one third the speed thereof.

To select forward drive for screwing into a workpiece, the support frame 82 and the adjusting finger or plate 84 are pivoted to a vertical position, the marker lines 63 on the outer sleeve 56 are aligned with the cut-outs or slots 48 on the gear support plate 46 and the outer sleeve 56 is slid towards the chuck 10 to cover these slots 48. In this condition, the gear support plates 46 and 47 and the gears 53 can rotate bodily to cause the drive from the shaft 43 to be transmitted to the output drive shaft 68 in the same sense of rotation at a speed three times the reverse drive speed.

The dimple 59 on the flat tension spring 58 is received in the appropriate groove 49 on the inner sleeve 40 to locate the outer sleeve 56 in a position where it exposes the recesses or slots 48 or a position where it conceals the latter.

Figure 10:
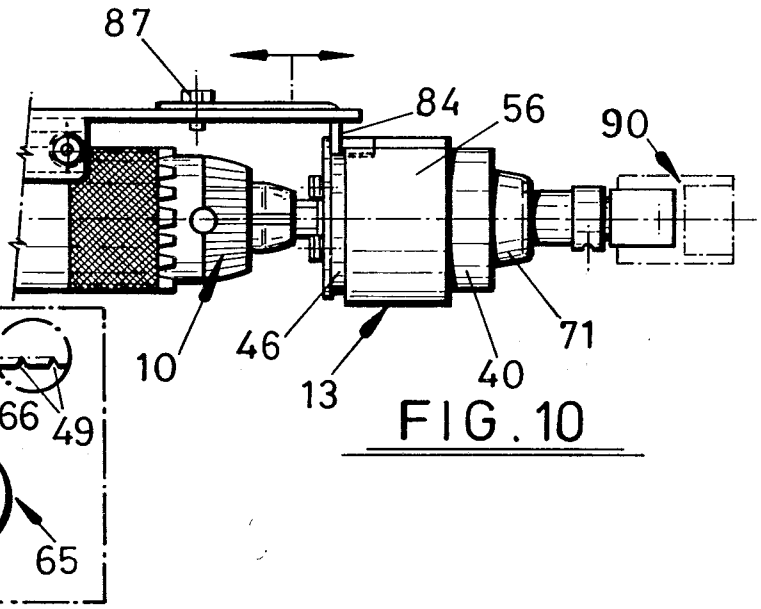
FIG. 10 is a fragmentary side elevation of a modification of the device incorporating a socket holder.
Figure 9:
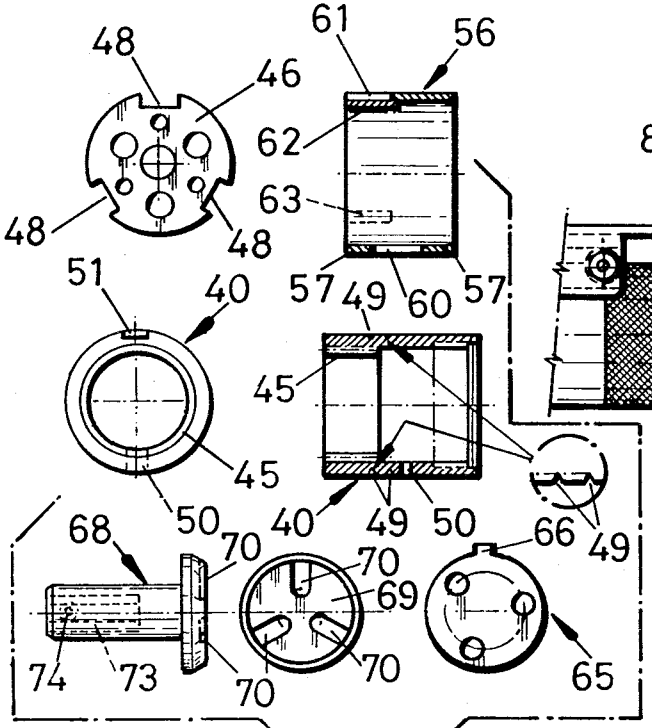
FIG. 9 is a detail view of various components of the directional-control and torque-adjustment mechanism.

In a modification (see FIG. 10) the screwdriver mechanism 12 is replaced by a socket adaptor 90 which is detachably engaged in the output drive shaft 68 but otherwise the tool is the same.

The device or tool according to the present invention can readily be fitted to any power drill; it can accommodate many differently-sized screws; a screw is automatically released when it is driven home; and it permits screws to be driven effortlessly into wood, masonry or metal.

What is claimed is:

1. A device for rotating a screw into and out of a workpiece, the device adapted to be secured to a rotary machine and to a driven member and comprising a mechanism for controlling the depth the screw is to be driven into the workpiece including clutch means rotatably associated with the rotational-direction determining mechanism for transmitting rotation from the rotary machine to the driven member, and a planetary planet gear carrier including at least one support plate, a central sun gear, and at least one planet gear in meshing engagement with the sun gear and the annular gear, and locking means for locking the planet gear carrier into a position relative to the rotary machine whereby the driven member rotates in a forward rotational direction when the planet gear carrier is unlocked, and in a reverse rotational direction when the planet gear carrier is locked.

2. A device is claimed in claim 1, in which the gear ratios of the planetary gear system are selected so that the speed of reverse rotation is less than that of forwards rotation, preferably one third of the latter.

3. A device as claimed in claim 1, in which the planetary gear system is housed in an inner sleeve whereof part of the inner surface is toothed to provide the annular gear of the planetary gear system.

4. A device as claimed in claim 3 in which the planet gear carrier comprises a pair of support plates between which the planet gears are supported with one of the plates being external of the inner sleeve housing and being peripherally slotted or recessed to receive said locking means.

5. A device as claimed in claim 4, wherein said locking means comprises a control mechanism detachably connectible with the rotary machine and comprising an arm or finger adapted to be moved between a first position clear of the planetary gear system and a second position where the arm or finger engages the peripheral slot or recess in the planet gear provided to lock same against bodily rotation.

6. A device as claimed in claim 5, in which the arm of finger is carried on a support plate pivoted to a clamp adapted to be detachably connected on a stationary part of the rotary machine.

7. A device as claimed in claim 6, in which the arm or finger is adjustably mounted on the support plate.

8. A device as claimed in claim 6, in which the support plate is spring loaded relative to the clamp to the position clear of the planetary gear system.

9. A device as claimed in claim 4, including an outer sleeve surrounding the inner sleeve housing and axially movable relative thereto to expose or conceal said peripheral slots or recesses.

10. A device as claimed in claim 9, in which the outer sleeve includes a dimple or projection on its inner surface adapted to seat in one of two axially-spaced grooves on the outer surface of the inner sleeve thereby either exposing or concealing the peripheral slot or recess.

11. A device as claimed in claim 3, in which the clutch means comprises a pair of plates housed within the inner sleeve, the plates being drivingly connectible by balls carried by the first plate and engaging the second, with the ball-carrying first plate being keyed to the inner sleeve.

12. A device as claimed in claim 11, in which a torque-adjusting cap is connected into the inner sleeve, a clutch-loading spring being disposed between the cap and the second plate, a relative movement between the cap and the inner sleeve varying said loading and consequently the torque applied to the driven member.

13. A device as claimed in claim 11, in which the second clutch plate has connected thereto an output drive shaft which projects out of the torque-adjusting cap.

14. A device as claims in claim 13, in which the output drive shaft is hollow removably to receive the driven member.

15. A device as claimed in claim 14, in combination with a socket adaptor connectible directly to the output drive shaft.

16. A device as claimed in claim 14, in combination with a screw-holding mechanism incorporating the driven member, said mechanism comprising an elongate member having one end drivingly received in the output drive shaft and a recess in the other end thereof, the driven member being removably engageable within said recess which is adapted to prevent relative rotation between said elongate member and said driven member, screw-retaining or holding means slidably mounted on said elongate member so as to be movable longitudinally relative thereto, said screw-retaining means comprising inner and outer sleeve members mounted on said elongate member so as to be slidable relative to each other, at least one movable member being located by said inner sleeve member but movable radially thereof, and a recess in said outer sleeve member adapted to receive said movable member, and first and second spring means operable to bias said inner and outer sleeve members respectively longitudinally of said elongate member away from said one end.

17. A device as claimed in claim 16, wherein said driven member comprises a screw driver blade.

18. A device as claimed in claim 16, wherein said driven member comprises an allen key.

19. A device as claimed in claim 16, wherein said one end of the elongate member is of circular cross-section.

20. A device as claimed in claim 16, wherein said recess in said elongate member is adapted to receive a head of a screw therein.

21. A device as claimed in claim 16, wherein said inner sleeve member has at least one aperture therein, a movable member being retained in each aperture for movement therein radially of said device.

22. A device as claimed in claim 21, wherein said inner sleeve member has therein a plurality of equiangularly spaced apertures, each aperture having a lip at the innermost end thereof whereby said movable members are prevented from passing through said apertures and from mutual contact when in their innermost positions.

23. A device as claimed in claim 21, wherein said outer sleeve member comprises an inner conical surface which in use in engaged by each movable member.

24. A device as claimed in claim 23, wherein said conical surface is stepped.

25. A device as claimed in claim 1, in which the sun wheel of the planetary gear system is carried by a shaft connectible to the rotary machine.

26. A device for rotating a screw into or out of a workpiece, the device being adapted to be drivingly connected to a rotary machine, the device comprising:

(A) an annular screw holding mechanism, a rotatable screw-driving member housed within the annular screw holding mechanism, the latter and the screw-driving member being relatively axially movable whereby the screw-driving member extends axially outwards of the annular screw-holding mechanism at the end of a screw-insertion operation and at the commencement of a screw extraction operation;

(B) a mechanism for determining the direction of rotation of the screw-driving member, which mechanism is drivingly connectible to the rotary machine and is drivingly connected to the screw-driving member and comprises a planetary gear system including a toothed annulus, a sun gearwheel drivingly coupled to the screw-driving member, planet gearwheels interconnecting the toothed annulus and the sun gearwheel, and a planet gearwheel carrier, a locking device mountable in a stationary manner on the rotary machine and movable between a position where it engages the planet gearwheel carrier to lock same against rotation whereby the planetary gear system permits rotation of the screw-driving member in a screwextraction direction and a position where it is clear of the planet carrier which is thus free to rotate whereby the planetary gear system permits rotation of the screw-driving member in a screw-insertion direction;

(C) a torque-adjusting mechanism between the sun gearwheel of the planetary gear system and the screw-driving member and comprising a clutch means drivingly connecting the sun gearwheel and the screw-driving member and including an adjustable resilient loading, and an adjustment device operatively connected with the resilient loading whereby the torque applied to the rotatable screw-driving member by the rotary machine can be varied, thereby controlling the depth the screw is to be driven into the workpiece.

27. A device as claimed in claim 26, in which the gear ratios of the planetary gear system are selected to that the speed of reverse rotation is less than that of forwards rotation, preferably one third of the latter.

28. A device as claimed in claim 26, in which the planetary gear system is housed in an inner sleeve whereof part of the inner surface of the inner sleeve is toothed to provide the annulus of the planetary gear system.

29. A device as claimed in claim 28 in which the planet gearwheel carrier comprises a pair of plates between which the planet gearwheels are supported with one of the plates being external of the inner sleeve and having a peripheral recess to permit the locking device to engage same.

30. A device as claimed in claim 29, having an outer sleeve surrounding the inner sleeve and axially movable relative thereto to expose or conceal said peripheral recess.

31. A device as claimed in claim 30, in which the outer sleeve has an internal projection adapted to seat in one of two axially-spaced grooves on the outer surface of the inner sleeve, such that the recess is either exposed or concealed.

32. A device as claimed in claim 28, in which the clutch means comprises a pair of plates housed within the inner sleeve, balls carried by one plate and engaging the other thereby drivingly connecting the plates, and the ball-carrying plate being keyed to the inner sleeve.

33. A device as claimed in claim 32, in which a torque-adjusting cap is adjustably connected into the inner sleeve, the resilient loading of the clutch means being a spring disposed between the cap and the other plate, the cap being movable relative to the inner sleeve to vary said loading and consequently the torque applied to the screw-driving member.

34. A device as claimed in claim 32, in which the other clutch plate has connected thereto an output drive shaft which projects out of the torque-adjusting cap.

35. A device as claimed in claim 34, in which the output drive shaft is hollow to removably receive the screw driving member.

36. A device as claimed in claim 35, in combination with a socket adaptor connectible directly to the output drive shaft.

37. A device as claimed in claim 35, in which the annular screw-holding mechanism comprises an elongate member having one end drivingly received in the output drive shaft and a holding recess in the other end thereof, the screw-driving member being removably engageable within said holding recess which is adapted to prevent relative rotation between said elongate member and said screw-driving member, screw-retaining means slidably mounted on said elongate member so as to be movable longitudinally relative thereto, and said retaining means comprising inner and outer sleeve members mounted on said elongate member so as to be slidable relative thereto and to each other, at least one movable member being located by said inner sleeve member but movable radially thereof and a recess in said outer sleeve member adapted to receive said movable member, and first and second spring means operable to bias said inner and outer sleeve members respectively longitudinally of said elongate member away from said one end.

38. A device as claimed in claim 37, wherein said one end is of circular cross-section.

39. A device as claimed in claim 37, wherein said recess in said elongate member is adapted to receive a head of a screw therein.

40. A device as claimed in claim 37, wherein said inner sleeve member has at least one aperture therein, a movable member being retained in each aperture for movement therein radially of said device.

41. A device as claimed in claim 40, wherein said inner sleeve member has therein a plurality of equiangularly spaced apertures, each aperture having a lip at the innermost end thereof whereby said movable members are prevented from passing through said apertures and from mutual contact when in their innermost positions.

42. A device as claimed in claim 40, wherein said outer sleeve member comprises an inner conical surface which, in use, is engaged by each movable member.

43. A device as claimed in claim 42, wherein said conical surface is stepped.

44. A device as claimed in claim 26, in which the sun wheel of the planetary gear system is carried by a shaft connectible to the rotary machine.

45. A device as claimed in claim 26, in which the locking device comprises a finger adapted to be moved between a position clear of the planetary gear system, thereby selecting forward rotation, and a position where the finger engages the peripheral recess in the planet gearwheel carrier to lock same against bodily rotation, thereby selecting reverse rotation.

46. A device as claimed in claim 45, in which the finger is carried on a support plate pivoted to a clamp detachably connected to a stationary part of the rotary machine.

47. A device as claimed in claim 46, in which the finger is adjustably mounted on the support plate.

48. A device as claimed in claim 46, in which the support plate is spring loaded relative to the clamp to the position clear of the planetary gear system.

49. A device as claimed in claim 26, wherein said screw-driving member comprises a screw driver blade.

50. A device as claimed in claim 26, wherein said screw-driving member comprises an allen key.

* * * * *